US006042150A

United States Patent [19]

Daley

[11] Patent Number: 6,042,150

[45] Date of Patent: Mar. 28, 2000

[54] PLAYING CARDS SECURITY SYSTEM

[76] Inventor: Christopher B. Daley, 63 Kintyre Street, Courtice, Ontario, Canada, L1E 2Y6

[21] Appl. No.: 09/133,467

[22] Filed: Aug. 13, 1998

[51] Int. Cl.[7] ..... B42D 15/00

[52] U.S. Cl. ..... 283/86; 250/271; 283/89; 283/91; 382/116

[58] Field of Search ..... 283/89, 91, 86; 382/116; 250/271

[56] References Cited

U.S. PATENT DOCUMENTS

| | | | |
|---|---|---|---|
| 4,534,562 | 8/1985 | Cuff et al. | 273/149 P |
| 4,662,637 | 5/1987 | Pfeiffer | 273/149 P |
| 4,889,367 | 12/1989 | Miller | 283/88 |
| 4,978,305 | 12/1990 | Kraft | 434/353 |
| 5,067,713 | 11/1991 | Soules et al. | 273/149 P |
| 5,169,155 | 12/1992 | Soules et al. | 273/293 |
| 5,259,907 | 11/1993 | Soules et al. | 156/277 |
| 5,742,411 | 4/1998 | Walters | 283/91 |
| 5,900,954 | 5/1999 | Katz et al. | 283/86 |

*Primary Examiner*—Andrea L. Pitts
*Assistant Examiner*—Monica Smith

[57] ABSTRACT

A playing cards security system for detecting when additional playing cards are added to a deck of playing cards. The system includes a deck of playing cards where each playing card of the deck of playing cards has predetermined indicia provided thereon. The predetermined indicia of the each of the playing cards is the same as the predetermined indicia of the other playing cards of the deck of playing cards. The predetermined indicia is viewable under ultraviolet light and hidden from view under ambient light.

5 Claims, 2 Drawing Sheets

PLAYING CARDS SECURITY SYSTEM

BACKGROUND OF THE INVENTION

1. Field of the Invention

The present invention relates to playing cards and more particularly pertains to a new playing cards security system for detecting when additional playing cards are added to a deck of playing cards.

2. Description of the Prior Art

The use of playing cards is known in the prior art. More specifically, playing cards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,126,373; U.S. Pat. No. 3,668,795; U.S. Pat. No. 4,681,324; U.S. Pat. No. 5,037,101; U.S. Pat. No. 3,552,853; and U.S. Pat. No. 4,269,473.

While these devices fulfill their respective, particular objectives and requirements, the aforementioned patents do not disclose a new playing cards security system. The inventive device includes a deck of playing cards where each playing card of the deck of playing cards has predetermined indicia provided thereon. The predetermined indicia of the each of the playing cards is the same as the predetermined indicia of the other playing cards of the deck of playing cards. The predetermined indicia is viewable under ultra-violet light and hidden from view under ambient light.

In these respects, the playing cards security system according to the present invention substantially departs from the conventional concepts and designs of the prior art, and in so doing provides an apparatus primarily developed for the purpose of detecting when additional playing cards are added to a deck of playing cards.

SUMMARY OF THE INVENTION

In view of the foregoing disadvantages inherent in the known types of playing cards now present in the prior art, the present invention provides a new playing cards security system construction wherein the same can be utilized for detecting when additional playing cards are added to a deck of playing cards.

The general purpose of the present invention, which will be described subsequently in greater detail, is to provide a new playing cards security system apparatus and method which has many of the advantages of the playing cards mentioned heretofore and many novel features that result in a new playing cards security system which is not anticipated, rendered obvious, suggested, or even implied by any of the prior art playing cards, either alone or in any combination thereof.

To attain this, the present invention generally comprises a deck of playing cards where each playing card of the deck of playing cards has predetermined indicia provided thereon. The predetermined indicia of the each of the playing cards is the same as the predetermined indicia of the other playing cards of the deck of playing cards. The predetermined indicia is viewable under ultra-violet light and hidden from view under ambient light.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new playing cards security system apparatus and method which has many of the advantages of the playing cards mentioned heretofore and many novel features that result in a new playing cards security system which is not anticipated, rendered obvious, suggested, or even implied by any of the prior art playing cards, either alone or in any combination thereof.

It is another object of the present invention to provide a new playing cards security system which may be easily and efficiently manufactured and marketed.

It is a further object of the present invention to provide a new playing cards security system which is of a durable and reliable construction.

An even further object of the present invention is to provide a new playing cards security system which is susceptible of a low cost of manufacture with regard to both materials and labor, and which accordingly is then susceptible of low prices of sale to the consuming public, thereby making such playing cards security system economically available to the buying public.

Still yet another object of the present invention is to provide a new playing cards security system which provides in the apparatuses and methods of the prior art some of the advantages thereof, while simultaneously overcoming some of the disadvantages normally associated therewith.

Still another object of the present invention is to provide a new playing cards security system for detecting when additional playing cards are added to a deck of playing cards.

Yet another object of the present invention is to provide a new playing cards security system which includes a deck of playing cards where each playing card of the deck of playing cards has predetermined indicia provided thereon. The predetermined indicia of the each of the playing cards is the same as the predetermine indicia of the other playing cards of the deck of playing cards. The predetermined indicia is viewable under ultra-violet light and hidden from view under ambient light.

Still yet another object of the present invention is to provide a new playing cards security system that allows a user to quickly determine whether a playing card is part of the deck or has been subsequently added to the deck.

Even still another object of the present invention is to provide a new playing cards security system that allows a user to quickly determine if a card cheater is adding cards to a deck.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
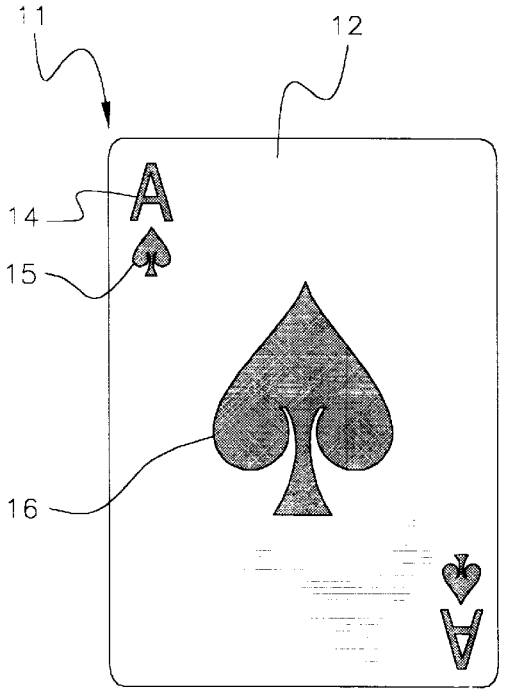
FIG. 1 is a schematic front face view of a playing card of a new playing cards security system according to the present invention.
Figure 2:
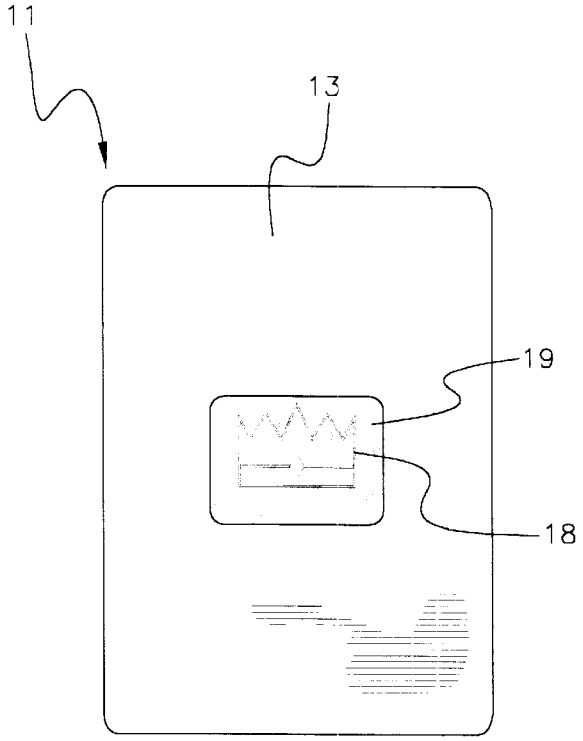
FIG. 2 is a schematic back face view of a playing card of the present invention viewed under regular ambient light.
Figure 3:
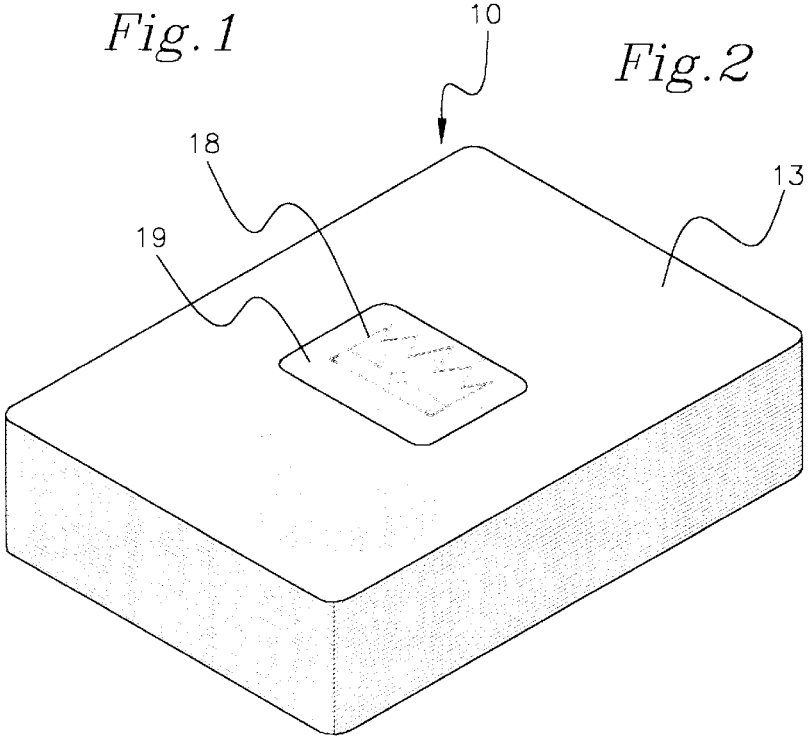
FIG. 3 is a schematic perspective view of a deck of playing cards of the present invention viewed under regular ambient light.
Figure 4:
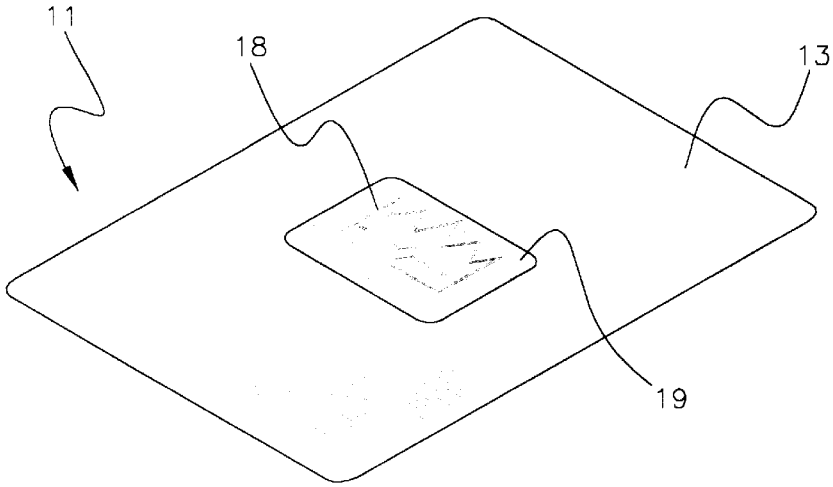
FIG. 4 is a schematic perspective view the back face of a playing card of the present invention when viewed under regular ambient light.
Figure 5:
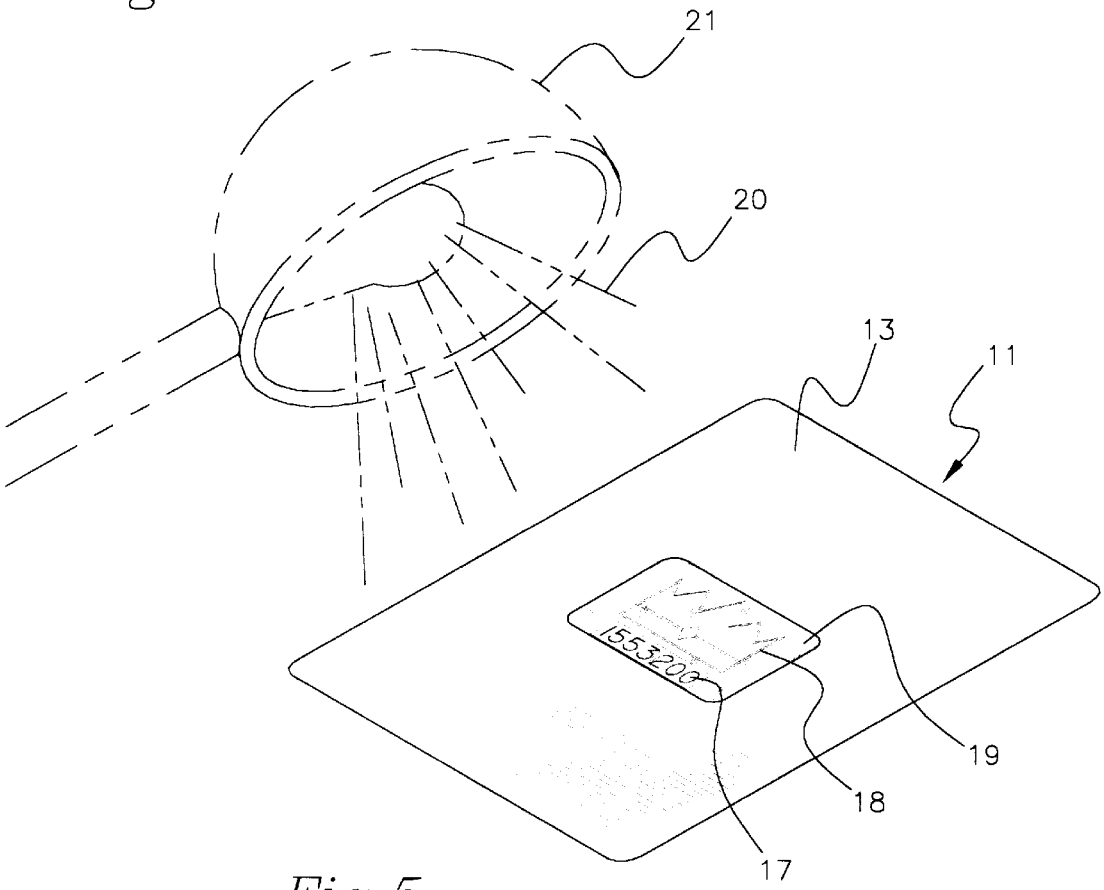
FIG. 5 is a schematic perspective view of a playing card of the present invention viewed under ultra-violet light to make the predetermined indicia on the card visible to a user.

With reference now to the drawings, and in particular to FIGS. 1 through 5 thereof, a new playing cards security system embodying the principles and concepts of the present invention will be described.

As best illustrated in FIGS. 1 through 5, the playing cards security system generally comprises a deck of playing cards 10 where each playing card 11 of the deck of playing cards 10 has predetermined indicia 17 provided thereon. The predetermined indicia 17 of the each of the playing cards 11 is the same as the predetermined indicia of the other playing cards 11 of the deck of playing cards 10. The predetermined indicia 17 is viewable under ultra-violet light 20 and hidden from view under ambient light.

In use, the security system is designed for detecting when additional playing cards are added to a deck of playing cards such as by a card cheater. In closer detail, the each playing card 11 of a deck of cards 10 of the security system has front and back faces 12,13. The front face 12 of each playing card 11 has a card face typically comprising a corner index 14, a suit marker 15 and a pip 16 indicating a particular value of the particular playing card 11. The back face 13 of each of the playing cards 11 of the deck of playing cards 10 has predetermined indicia 17 provided thereon. The predetermined indicia 17 of the each of the playing cards 11 is the same as the predetermined indicia of the other playing cards 11 of the deck of playing cards 10. The predetermined indicia 17 is preferably unique to the deck of playing cards 10 such that no other decks of playing cards has the same indicia as the deck of playing cards 10. Ideally, the predetermined indicia 17 comprises a serial number such that each playing card 11 of the deck of playing cards 10 has the same serial number unique to that particular deck of playing cards 10 and no other deck of playing cards.

Preferably, the back face 13 of each playing card 11 has an image 18 provided thereon. Ideally, the image 18 comprises a holographic image. The image 18 is preferably centrally positioned on the back face 13 of the playing card 11. The holographic image 18 is provided in a display area 19 comprising a medium for producing a holographic image 18. The predetermined indicia 17 is preferably located in the display area 19. The display area 19 is preferably centrally positioned on each playing card 11 of the deck of playing cards 10. Ideally, the display area 19 has a generally rectangular perimeter having sides parallel to edges of the playing card 11 although the periphery of the display area 19 may be formed in any desired shape.

The predetermined indicia 17 is viewable only under ultra-violet light 20 from an ultra-violet light source 21 and hidden from view under ambient light of the visible spectrum such as daylight, or light from light fixtures. In use, this allows a user to quickly check a deck of playing cards to see if playing cards have been added to the deck. If a playing card is discovered not having the predetermined indicia or with predetermined indicia not match the rest of the playing cards of the deck, the user will then know that that particular playing card has been subsequently added to the deck.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security system for a deck of playing cards, comprising:

a deck of playing cards;

each of said playing cards of the deck of playing cards having predetermined indicia provided thereon;

said predetermined indicia of said each of said playing cards being the same as the predetermined indicia of the other playing cards of the deck of playing cards, said predetermined indicia comprising a serial number such that each playing card of said deck of playing cards has the same serial number unique to that particular deck of playing cards; and said predetermined indicia being viewable to a user under ultra-violet light and hidden from view under ambient light.

2. The security system or claim 1, wherein each playing card has front and back faces, said front face of each playing card indicating a particular value of the playing card, said predetermined indicia being provided on said back face of each playing card.

3. The security system of claim 1, wherein said predetermined indicia is unique to the deck of playing cards.

4. The security system of claim 1, wherein each playing card has front and back faces, wherein said back face of each playing card has an image provided thereon, said image being provided in a display area comprising a medium for producing a holographic image, said predetermined indicia being located in said display area.

5. A security system for a deck of playing cards for allowing a user to detect when additional playing cards are added to a deck of playing cards, said security system, comprising:

a deck of playing cards;

wherein each playing card has front and back faces;

said front face of each playing card indicating a particular value of the playing card, said back face of each of said playing cards of the deck of playing cards having predetermined indicia provided thereon;

said predetermined indicia of said each of said playing cards being the same as the predetermined indicia of the other playing cards of the deck of playing cards;

said predetermined indicia being unique to the deck of playing cards;

wherein said predetermined indicia comprises a serial number such that each playing card of said deck of playing cards has the same serial number unique to that particular deck of playing cards;

said back face of each playing card having an image provided thereon, wherein said image comprises a holographic image, said image being centrally positioned on said back face of the playing card;

said holographic image being provided in a display area comprising a medium for producing a holographic image, said display area being centrally positioned on each playing card of said deck of playing cards, said display area having a generally rectangular perimeter having sides parallel to edges of the playing card;

said predetermined indicia being located in said display area; and said predetermined indicia being viewable to the user under ultra-violet light and hidden from view under ambient light.

* * * * *